US006263581B1

(12) United States Patent
Forte

(10) Patent No.: US 6,263,581 B1
(45) Date of Patent: Jul. 24, 2001

(54) HUNTING KNIFE WITH REMOVABLE BLADE EDGES

(76) Inventor: Philip Forte, 603 Lackawanna Ave., West Paterson, NJ (US) 07424

( * ) Notice: Subject to any disclaimer, the term of this patent is extended or adjusted under 35 U.S.C. 154(b) by 0 days.

(21) Appl. No.: 09/044,067

(22) Filed: Mar. 19, 1998

(51) Int. Cl.[7] ..... B26B 5/00
(52) U.S. Cl. ..... 30/332; 30/329; 30/349
(58) Field of Search ..... 30/332, 337, 349, 30/329

(56) References Cited

U.S. PATENT DOCUMENTS 1,433,391 * 10/1922 McCaw ..... 30/349
1,813,723 * 7/1931 Beaver ..... 30/329
2,584,603 * 2/1952 McMillan et al. ..... 30/349
5,689,889 * 11/1997 Overholt ..... 30/332

FOREIGN PATENT DOCUMENTS

2718638 * 11/1978 (DE) ..... 30/332

* cited by examiner

*Primary Examiner*—Hwei-Siu Payer
(74) *Attorney, Agent, or Firm*—Anthony D. Cipollone

(57) ABSTRACT

A knurled handle grip hunting knife for field use with a hinged foldable blade holder to which may be attached replaceable blades by an attachment lever which attaches to a hooked replaceable blade allowing the hunter to easily replace blades in the field and conveniently store the knife when not in use and retrieve for use when needed.

2 Claims, 2 Drawing Sheets

HUNTING KNIFE WITH REMOVABLE BLADE EDGES

BACKGROUND OF THE INVENTION

1. Field of the Invention

The present invention relates to a Hunting Knife having a simple replaceable blade edges.

The advantages of such a Hunting Knife are readily employed in hunting, fishing, butcheries and even household use.

The replaceable cutting edge of the blade avoids the necessity for knife sharpening, a major task especially while hunting and fishing. The replaced dull blade edge may be sharpened at a more convenient time or disposed.

The Hunting Knife may easily be adopted for other uses such as butcheries, kitchen knife, etc.

2. Prior Art

U.S. Pat. No. 2,109,108 relates to knives and has a replaceable blade which is separable from a knife handle and go replaced with another blade.

U.S. Pat. No. 2,507,019 presents a reversible blade which utility is the performance of a double duty, stabbing and skinning.

U.S. Pat. No. 2,671,962 relates to hand tools, specifically construction tools, wherein a tool member such as a knife or saw blade is readily separated from its handle.

U.S. Pat. No. 4,180,909 introduces a knife with a tension rod insertable into an opening extending through a handle for retaining a replaceable blade at the other end of the handle.

U.S. Pat. No. 4,813,143 deals with a handle suitable for knives and other implements which permits a blade to be adjustable in length.

SUMMARY OF THE INVENTION

The petitioner introduces a blade holder to which replaceable blades may be mounted. The preferred embodiment here shown introduces a folding blade holder. Permanent blade holders may also be used for applications other than hunting and field use.

The replaceable blade holder (11) may be that used in butcheries, kitchens, cooking knifes and other applications where different knives are used.

Another immediately obvious advantage of the use of one basic knife with different attachments in the economy of space and simplicity of replacement of parts rather than whole knives which is economical where a large number of knives are used as, for example, in commercial butcheries, large restaurant butcheries, etc.

Foremost, however, are the advantages provided for a hunter in the field who may easily replace the blade when it becomes dull or contaminated and store it for later cleaning and sharpening.

These are the unique advantages of the present invention. There has been no previous introduction of such an application from the prior art.

The thrust of the invention also deals with its two main features:

a) Ease of replaceability of the blade as replaceable blade;

b) Compatibility and ease of handling by the hunter vis-a-vis, the foldability of the knife for easy storage and instant production for use.

Foremost, however; are the advantages provided for a hunter in the field who may easily replace the blade when it becomes dull or contaminated and store it for later cleaning and sharpening.

These are the unique advantages of the present invention. There has been no previous introduction of such an application from the prior art.

The blade is part of the blade section and not the whole blade as in the other inventions.

Further, the knife edge also may be used in a non-folding knife.

BRIEF DESCRIPTION OF THE INVENTION

DETAILED DESCRIPTION OF THE INVENTION

Figure 1:
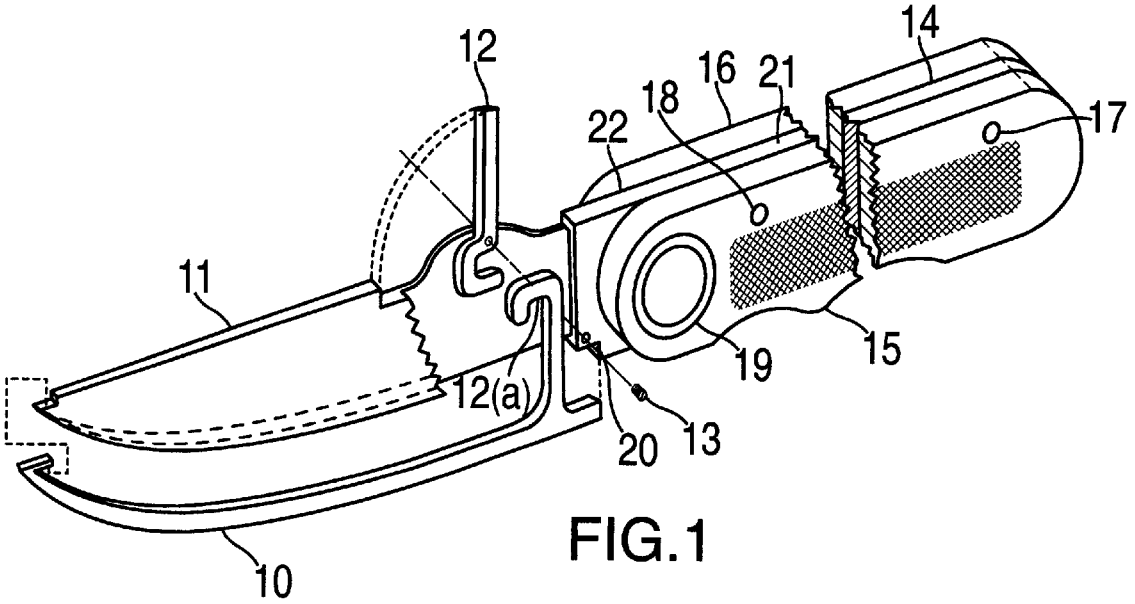
FIG. 1 is an exploded perspective view of the knife handle, blade holder and replaceable blades according to the present invention.
Figure 2:
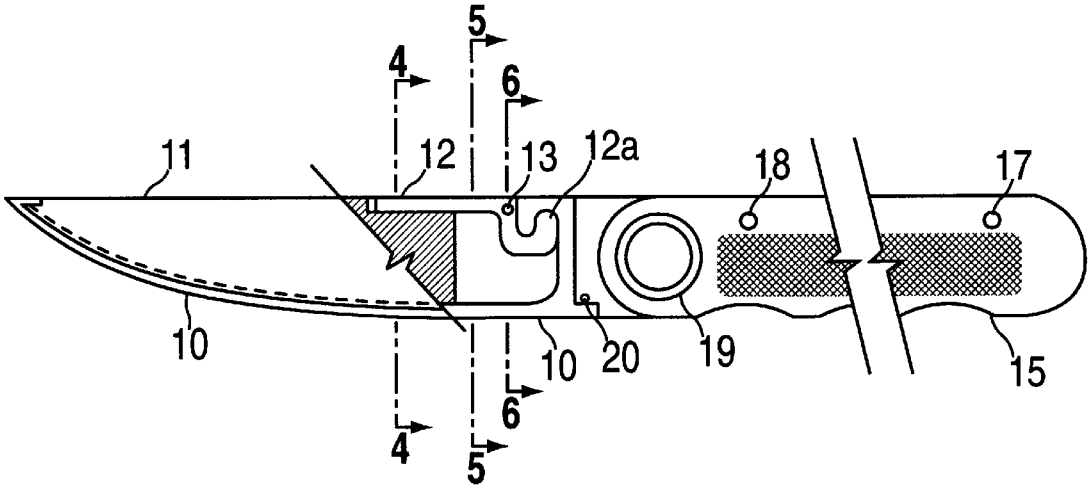
FIG. 2 is a side view of the knife handle, blade holder and replaceable blades, according to the present invention.
Figure 3:
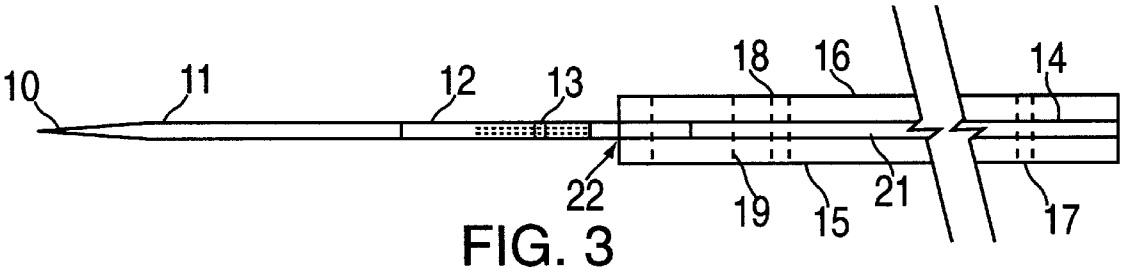
FIG. 3 is an edge view of the knife handle blade holder and replaceable blades, according to the present invention.
Figure 4:
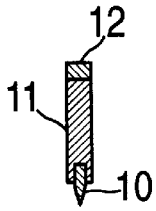
FIG. 4 is an edge view looking from the blade point backwards.
Figure 5:
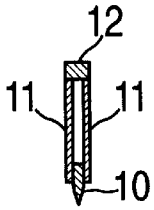
FIG. 5 is the same perspective as FIG. A—A except past the front blade section.
Figure 6:
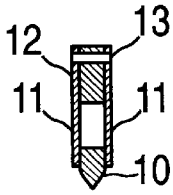
FIG. 6 is a perspective from the hinged portion of the blade.

FIG. 1 shows a knife comprising a knurled handle grip formed of two spaced-apart halves (15,16). The two halves (15,16) are attached to each other by rivets (17,18). A handle grip compartment (21) is formed between the two spaced-apart halves (15,16).

A blade holder (11) is secured to the handle grip by a spring release mechanism (19) and is pivotable to a storage position within the handle grip compartment (21). The blade holder (11) tapers toward the front end **(11*b*) of the holder (11) and has a sleeve (11*a*) formed on one edge of the holder (11) for releasably receiving a replaceable blade (10). The blade holder (11) further comprises a notch (20) formed on the tang (22) of the blade holder (11). The notch (20) is adapted to engage with a detent of the spring release mechanism (19) for retaining the blade holder (11) in a closed position in which the blade holder (11) is held within the handle grip compartment (21)**.

An attachment lever (12) is pivotally attached to the blade holder (11) by a lever attachment screw (13). A replaceable blade (10) has a blade hook **(12*a*) onto which the attachment lever (12) can be hooked for holding the replacement blade (10) to the blade holder (11). The replaceable blade (10) can be released from the blade holder (11) by removing the attachment lever (12) from the blade hook (12*a*)**.

What is claimed is:

1. A hunting knife comprising:

a knurled handle grip having two spaced-apart halves (15,16) secured together by rivets (17,18);

a blade holder (11) tapering toward the front end thereof and having a tang (22) sandwiched between the two halves (15,16), and a sleeve **(11*a*) formed along one edge of the blade holder (11)**;

an attachment lever (12) pivotally attached to the blade holder (11);

a replaceable blade (10) tapering toward the front end thereof and having a blade hook **(12*a*) onto which the attachment lever (12) can be hooked so that the tapered replaceable blade (10) is received in the sleeve (11*a*) of the tapered blade holder (11) for holding the blade (10) to the blade holder (11)**.

2. The hunting knife as in claim 1, wherein the replaceable blade (10) having a cross section corresponding to that of the blade holder (11) so that the replaceable blade (10) is receivable in the sleeve (11*a*).

* * * * *